US005406801A

United States Patent [19]

Inoue et al.

[11] Patent Number: 5,406,801

[45] Date of Patent: Apr. 18, 1995

[54] THERMALLY OPERATED REFRIGERATOR

[75] Inventors: Tatsuo Inoue; Shin Kawano, both of Anjo; Akira Tominaga, Tsuchiura, all of Japan

[73] Assignee: Aisin Newhard Co., Ltd., Kariya, Japan

[21] Appl. No.: 143,140

[22] Filed: Oct. 29, 1993

[30] Foreign Application Priority Data

Oct. 29, 1992 [JP] Japan ..... 4-333421

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,523,427 | 8/1970 | Simpson | 62/6 |
| 4,642,988 | 2/1987 | Benson | 62/6 |
| 4,822,390 | 4/1989 | Kazumoto et al. | 62/6 |
| 4,872,313 | 10/1989 | Kazumoto et al. | 62/6 |
| 5,088,288 | 2/1992 | Katagishi et al. | 62/6 |
| 5,177,971 | 1/1993 | Kiyota | 62/6 |

OTHER PUBLICATIONS

Graham Walker, "Cryocoolers Part 1: Fundamentals", Chapter 4, pp. 206–221, Plenum Press 1983.

*Primary Examiner*—Ronald C. Capossela
*Attorney, Agent, or Firm*—Burns, Doane, Swecker & Mathis

[57] ABSTRACT

A thermally operated refrigerator includes a hot space absorbing a heat from an outer heat source at a high temperature, an ambient space having a first portion and a second portion, a heat accumulator disposed between the hot space and the first portion of the ambient space for establishing a first fluid circuit in which an amount of operating fluid is filled, a hot displacer whose reciprocal movement establishes a periodical movement of the operating fluid in the first fluid circuit for rejecting the heat absorbed at the hot space to the first portion of the ambient space, a cold space absorbing a heat from a load at a low temperature, a cooler disposed between the cold space and the second portion of the ambient space for establishing a second fluid circuit in which an amount of operating fluid is filled, a cold displacer whose reciprocal movement establishes a periodical movement of the operating fluid in the second fluid circuit for rejecting the heat absorbed at the cold space to the second portion of the ambient space, a mechanism for driving the hot displacer and the cold displacer concurrently, an additional ambient space having a variable volume and disposed between the first portion and the second portion of the ambient space.

11 Claims, 6 Drawing Sheets

THERMALLY OPERATED REFRIGERATOR

FIELD OF THE INVENTION

The present invention relates to a thermally operated refrigerator and in particular to a Vuilleumier cycle refrigerator which is available as a cooler for use in an outer space, a cryogenic refrigerator such as a cryopump, or a heat pump for an air conditioner.

BACKGROUND OF THE INVENTION

In general, a Vuillemier cycle refrigerator is disclosed in a book titled "Cryocoolers Part 1: Fundamentals" (published by Plenum Press in 1983). Such a refrigerator, as shown in FIG. 1, includes a first cylinder 20 in which a hot displacer 2 is fitted. At an upper side and a lower side of the hot displacer 2, there are defined a hot space 4 and a first part 5A of an ambient space 5, respectively. The refrigerator also includes a second cylinder 21 in which a cold displacer 3 is fitted. At a right side and a left side of the cold displacer 3, there are formed a cold space 6 and a second part 5B of the ambient space 5, Respectively. The hot displacer 2 and the cold displacer 3 are connected to a crank mechanism 1 so as to be operated concurrently with a different phase. It is usual that a phase lag of 90 degrees is set between the hot displacer 2 and the cold displacer 3. The hot space 4 and the ambient space 5 are connected by a hot side regenerator or heat accumulator 7. The ambient space 5 and the cold space 6 are connected by a cold side regenerator or cooler 8. The foregoing elements except the crank mechanism 1 constitute a fluid circuit in which an operating fluid is filled. Helium gas or hydrogen gas is used as the operating fluid. Pressure fluctuations are produced by shuttling the operating fluid or gas periodically from the ambient space 5 to the hot space 4 by the action of the hot displacer 2. The pressure fluctuations produce refrigeration around the cold space 6 so as to absorb heat from a load 12 to be cooled. Thus, heat enters from the hot space 4 (cold space 6) and is derived to the radiator 11A (11B) for the ambient space 5.

In the foregoing structure, the displacements $\xi$ of the operating fluid in the heat accumulator 7 and the cooler 8 are illustrated in FIG. 2G and 2H, respectively, which are well-known. The pressure change of the operating fluid in each of the heat accumulator 7 and the cooler 8 is shown in FIG. 2I and is well-known. By combining FIG. 2G and FIG. 2I (FIG. 2H and FIG. 2I), FIG. 2E (FIG. 2F) can be obtained. It is to be noted in FIGS. 2A–2F the vertical axis denotes the pressure of the operating fluid, the positive direction of the horizontal axis denotes the decrease of the displacement $\xi$ of the operating fluid and each arrow along the line corresponds to one shown in FIG. 1.

Ideally speaking, in order to obtain high efficiency work (heat absorption) at the heat accumulator 7 (the cooler 8), in the heat accumulator 7, the operating fluid should be in heat-absorption with a pressure decrease or volume expansion at the hot space side and should be in heat radiation with a pressure increase or volume shrinkage at the ambient space side as shown in FIG. 2A. For the heat absorption in high efficiency, in the cooler 8, the operating fluid should be in heat-absorption with a pressure decrease or volume expansion at the cold space side and should be in heat radiation with a pressure increase or volume shrinkage at the ambient space side as shown in FIG. 2B. Comparing FIG. 2A with FIG. 2E (FIG. 2B with FIG. 2F), it is revealed that the conventional Vuillemier cycle refrigerator does not operate efficiently.

To realize the foregoing relationships illustrated in FIGS. 2A and 2B, the conventional Vuillemier cycle refrigerator should be such that the phase of the hot displacer 2 is substantially the same as that of the cold displacer 3. If such movements of the displacers 2 and 3 are established, phase lag does not occur between the change of the hot space 4 and the change of the cold space 6, resulting in less variation of the average temperature of the operating fluid. Thus, the pressure fluctuation becomes small. However, such structure is impractical. Contrary to the above, a phase difference of about 180 degrees between the hot displacer 2 and the cold displacer 3 will realize the maximum pressure fluctuation. Under such a situation, as seen from FIGS. 2C and 2D, no heat absorption and no heat radiation are established at each of the heat accumulator 7 and the cooler 8.

SUMMARY OF THE INVENTION

It is, therefore, a primary object of the present invention to provide a thermally operated refrigerator in which sufficient pressure fluctuation is generated as well as the realization of an ideal relationship between the displacement of the operating fluid and the pressure change of the operating fluid.

In order to attain the foregoing object, the present invention provides a thermally operated refrigerator which includes a hot space absorbing heat from an outer heat source at a high temperature, an ambient space having a first portion and a second portion, a heat accumulator disposed between the hot space and the first portion of the ambient space for establishing a first fluid circuit in which an amount of operating fluid is filled, a hot displacer whose reciprocal movement establishes a periodical movement of the operating fluid in the first fluid circuit for rejecting the heat absorbed at the hot space to the first portion of the ambient space, a cold space absorbing heat from a load at a low temperature, a cooler disposed between the cold space and the second portion of the ambient space for establishing a second fluid circuit in which an amount of operating fluid is filled, a cold displacer whose reciprocal movement establishes a periodical movement of the operating fluid in the second fluid circuit for rejecting the heat absorbed at the cold space to the second portion of the ambient space, a mechanism for driving the hot displacer and the cold displacer concurrently, and an additional ambient space having a variable volume and disposed between the first portion and the second portion of the ambient space.

BRIEF DESCRIPTION OF THE DRAWINGS

The above and other objects, features and advantages of the present invention will be more apparent and more readily appreciated from the following detailed description of preferred exemplarily embodiments of the present invention, taken in connection with the accompanying drawings, in which.

DESCRIPTION OF THE PREFERRED EMBODIMENTS

Embodiments of the present invention will be described hereinunder in detail with reference to the accompanying drawings.

Figure 3:
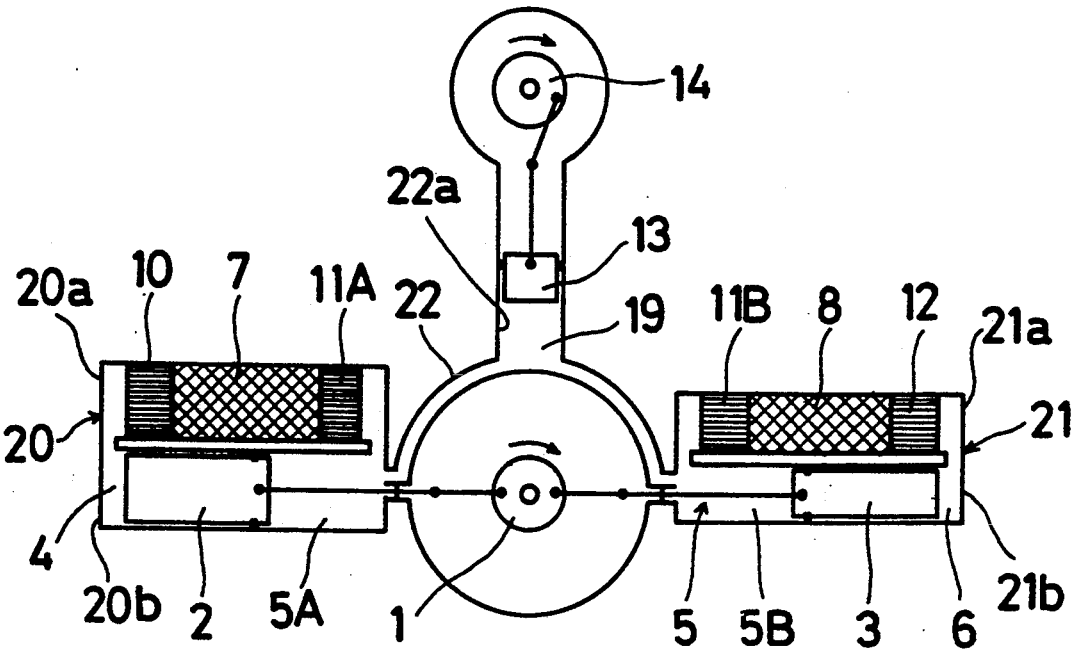
FIG. 3 is a view showing the first embodiment of the present invention.

Referring first to FIG. 3, a first embodiment of a thermally operated refrigerator includes a first casing 20 in which an upper portion 20*a* and a lower portion 20*b* are defined in such a manner that both ends of the upper portion 20*a* are in fluid communication with both ends of the lower portion 20*b*. Within the lower portion 20*b*, there is fitted a hot displacer 2 so that a hot space 4 and first portion 5A of an ambient space 5 are formed at a left side and a right side of the lower portion 20*b* respectively. In the upper portion 20*a*, a a heat-exchanger 10 which absorbs heat from a heat source, a regenerator or a heat accumulator 7, and a radiator 11A are arranged in this order from the hot space 4 to the ambient space 5.

The thermally operated refrigerator also includes a second casing 21 in which an upper portion 21*a* and a lower portion 21*b* are defined in such a manner that both ends of the upper portion 21*a* are in fluid communication with both ends of the lower portion 21*b*. Within the lower portion 21*b*, there is fitted a cold displacer 3 so that a cold space 6 and a second portion 5B of the ambient space 5 are formed at a right side and a left side of the lower portion 21*b* respectively. In the upper portion 21*a*, a heat-exchanger 12 which absorbs heat from a load at a low temperature, a regenerator or a cooler 8, and a radiator 11B are arranged in this order from the cold space 6 to the ambient space 5.

Figure 2A:
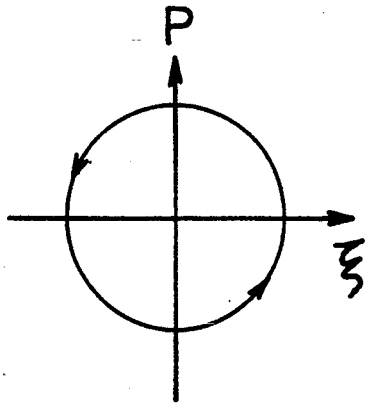
FIGS. 2(A)–2(F) are views each of which shows a relationship between the pressure and displacement of the operating fluid in the regenerator (heat accumulatir/cooler)

A crank mechanism 1 is connected to both of the displacers 2 and 3 so as to establish concurrent reciprocal movements thereof. Between the first casing 20 and the second casing 21, there is provide a third casing 22 having therein a third cylinder 22*a* so as to be connected to both casings 20 and 21. In the third cylinder 22*a*, a piston 13 is slidably fitted which is driven by another crank mechanism 14. However, the piston 13, the hot displacer 2, and the cold displacer 3 can be driven by a common crank mechanism. A space 19 is defined below the piston 13, and is in fluid communication with the first portion 5A and the second portion 5B of the ambient space 5. The volume of the space 19 varies periodically in accordance with the movement of the piston 13. The phase of the piston 13 is out of concern with or independent of that of each of the displacers 2 and 3, and depends on the temperature of the cold space 6. By delaying the piston 13 for 90 degrees relative to the hot displacer 2 (cold displacer 3), the relationship between the operating fluid displacement and the pressure change at the heat accumulator 7 (the cooler 8) can approach the condition as shown in FIG. 2(A) (FIG. 2(B)). It is to be noted that the 90-degree delay of the piston 13 relative to the hot displacer 2 (cold displacer 3) is common in all embodiments.

Figure 4:
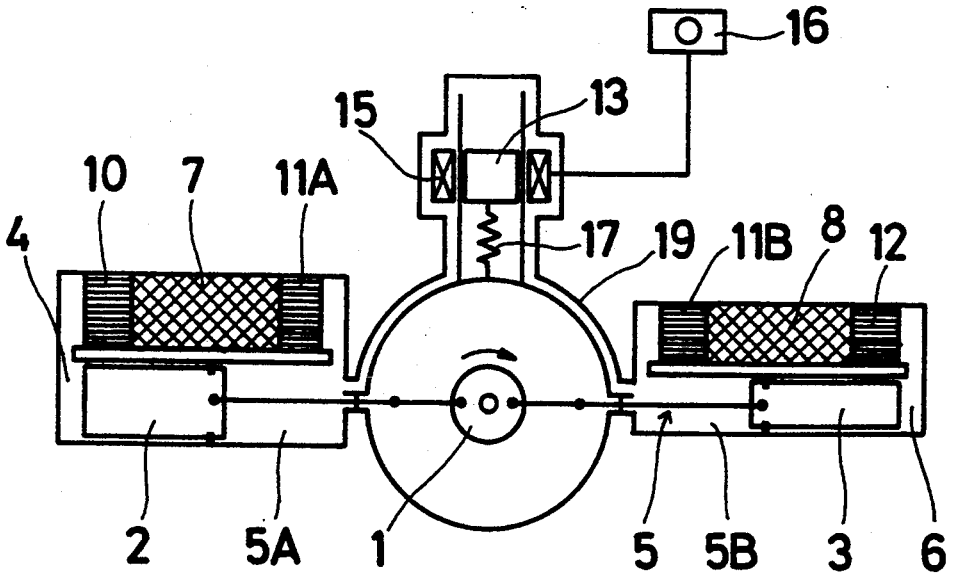
FIG. 4 is a view showing the second embodiment of the present invention.

Next, referring to FIG. 4, there is illustrated a second embodiment of a thermally operated refrigerator. In this device, the piston 13 is in the form of a permanent magnet and is supported by a spring 17. The spring 17 is positioned so as to be out of fluid communication with the space 19. The space 19 is in association with or in communication with an upper portion of the piston 13. The piston 13 and the spring 17 constitute a resonance system. Around the cylinder 22*a*, there is provided a coil 15 connected to a resister 16 as a load. By adjusting the value of the resister 16, the position of the piston 13 can be adjusted so that the volume of the space 19 can be varied. Thus, the phase difference between the displacers 2 and 3 can be adjusted. As it were, this embodiment is based on the piston 13 being moved according to the linear generator concept. It is to be noted that instead of the piston 13, the coil 15 may be used for adjusting the volume of the space 19. As to how to adjust the value of the resistor 16, a micro-processor (not shown) is used in such a manner that an angle of the crank mechanism 1 is fed to the micro-processor and the micro-processor varies the value of the register 16 depending on the resulting angle.

Figure 5:
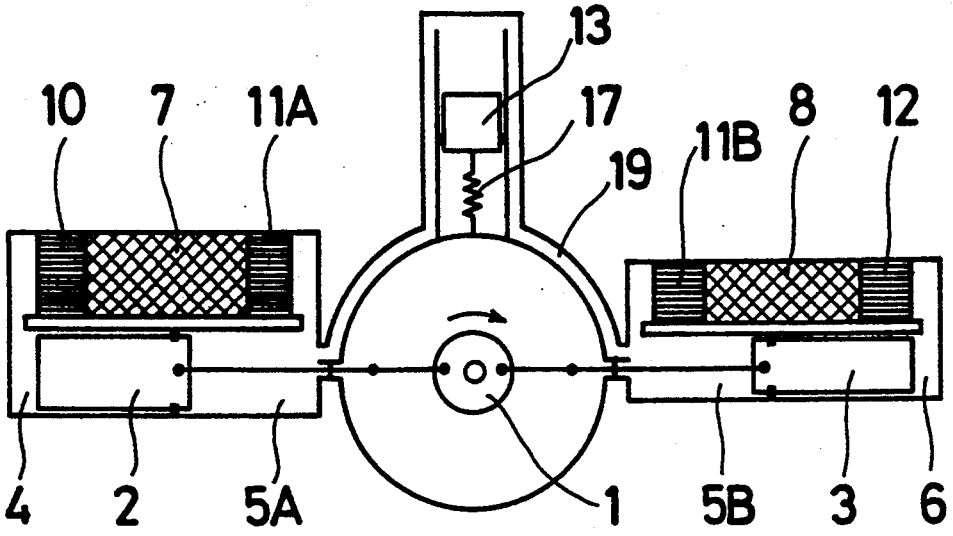
FIG. 5 is a view showing the third embodiment of the present invention.
Figure 6:
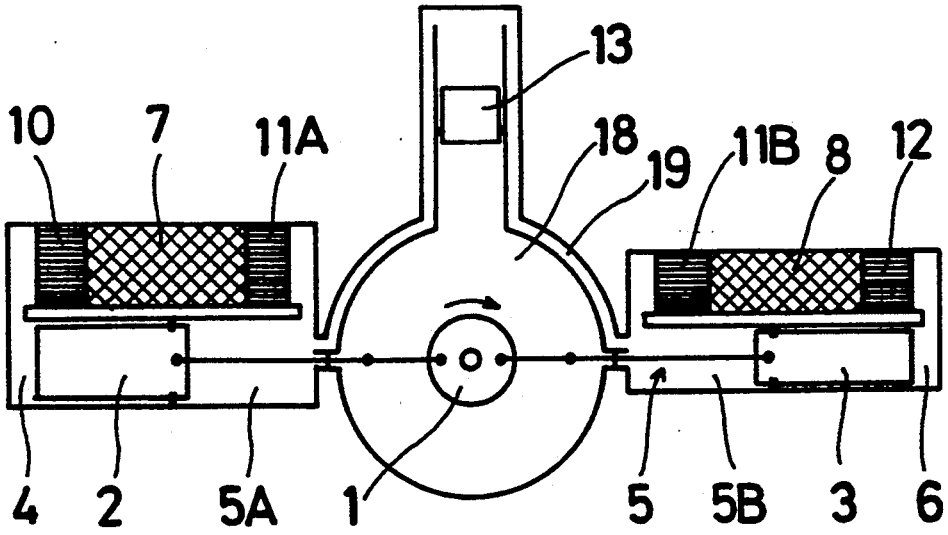
FIG. 6 is a view showing the fourth embodiment of the present invention.

In the third embodiment and the fourth embodiments shown in FIG. 5 and FIG. 6, respectively, the piston 13 is free from an outer control, and establishes an independent phase control. In FIG. 5, the spring 17 and the piston constitute a resonator system, and, in FIG. 6, a space 18 which is in opposition to the operating fluid is used as a gas spring. In general, when the resonant system is applied with a vibration as an outer force whose frequency is higher than the number of proper vibrations of the resonant system, the phase difference becomes about 180 degrees between the vibrations of the resonant system and the outer force. Upon application of this theorem on the fourth embodiment, if the frequency of the operating fluid fluctuation is greater than the proper vibration of the resonant system constituted by the piston 13 and the gas spring 19, the piston 13 is moved in the upward direction, and the ambient space 5 is varied. Thus, the relationship between the operating fluid displacement and the pressure change at the heat accumulator 7 (the cooler 8) can approach the condition as shown in FIG. 2(A) (FIG. 2(B)).

Figure 7:
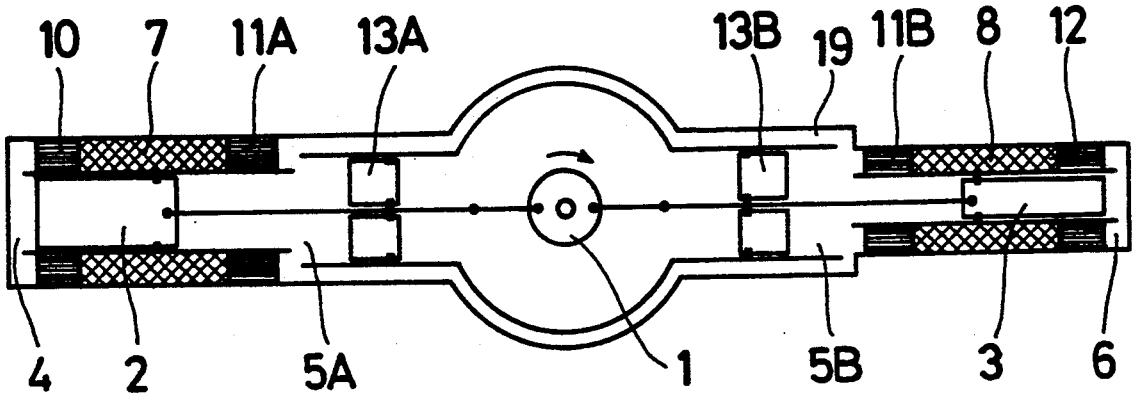
FIG. 7 is a view showing the fifth embodiment of the present invention.

In the fifth embodiment as shown in FIG. 7, a pair of pistons 13A and 13B are used each of which is equivalent to the piston 13 shown in FIG. 5 or 6.

Figure 1:
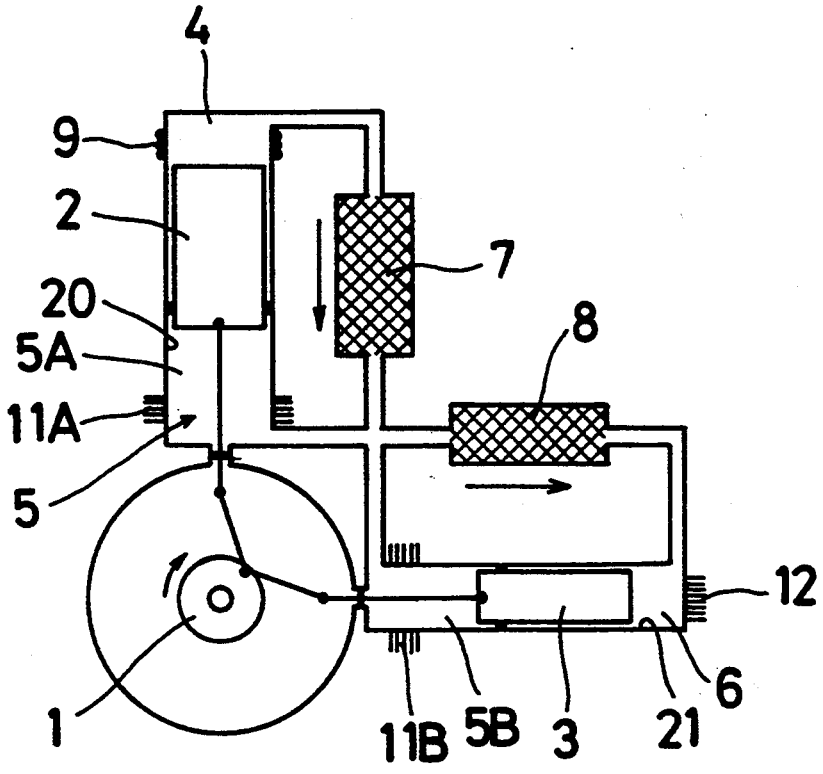
Fig. 1 (PRIOR ART)
FIG. 1 is a known conceptual diagram of a thermally operated refrigerator of Vuilleumier cycle.
Figure 2B:
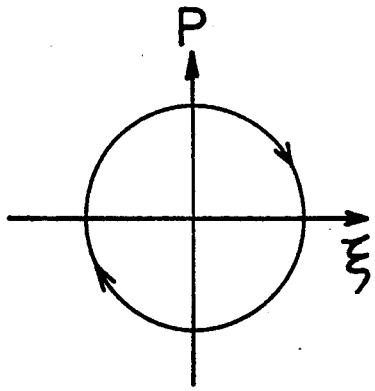
Figure 2C:
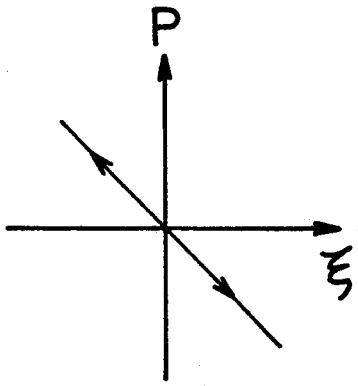
Figure 2D:
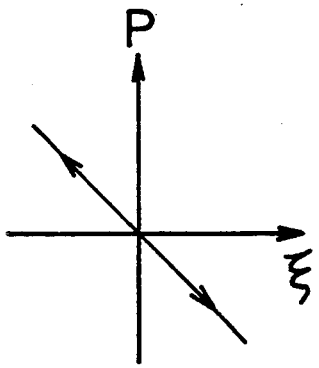
Figure 2E:
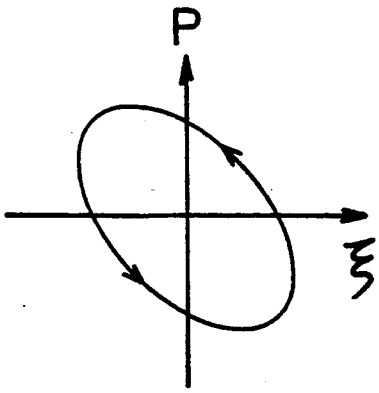
Figure 2F:
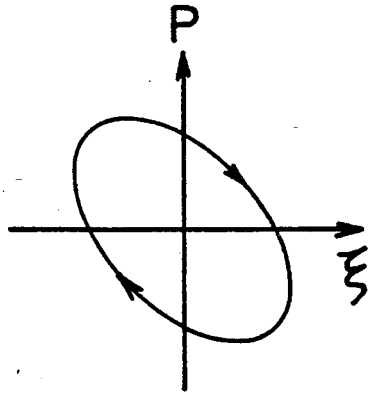
Figure 2:
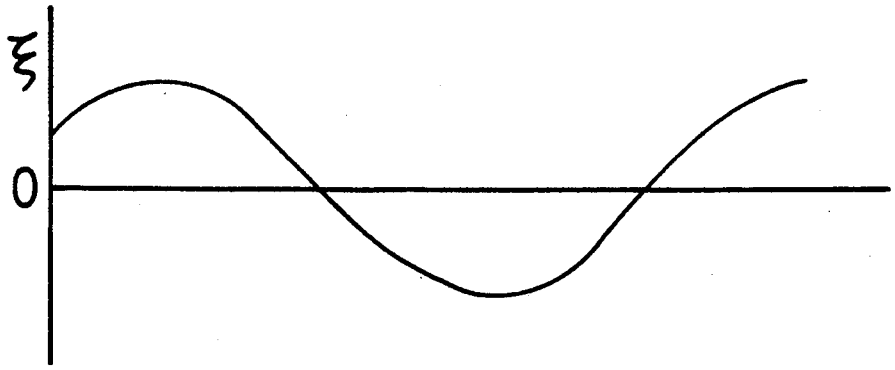
FIG. 2(G) shows the displacement of the operating fluid in the heat accumulator of the conventional device.
FIG. 2(H) shows the displacement of the operating fluid in the cooler of the conventional device.
FIG. 2(I) shows the pressure of the operating fluid in each of the heat accumulator and the cooler of the conventional device.
Figure 2:
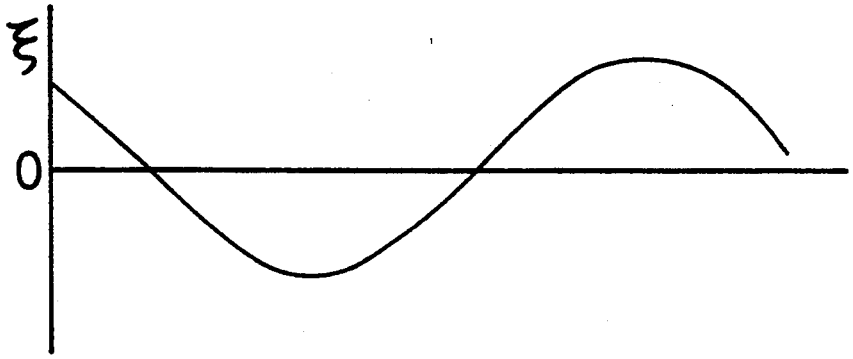
Figure 2:
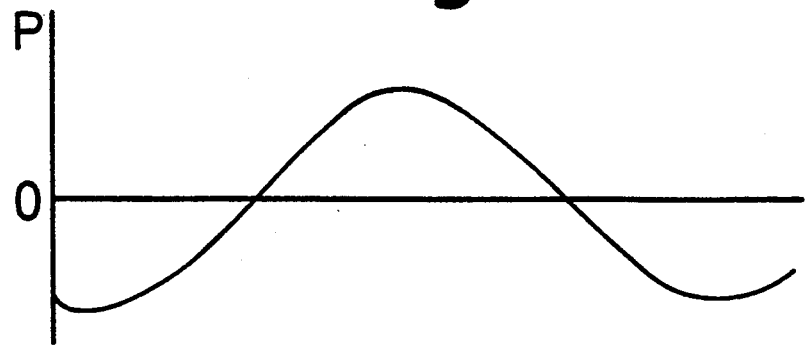

As apparent from the foregoing description, the gist of the present invention is to dispose an additional ambient space which is variable in volume between the hot side ambient space and the cold side ambient space so that the condition of the hot accumulator (cooler) becomes that shown in FIG. 2(A) (FIG. 2(B)). Thus, so long as the additional ambient space is added, out-of-phase movements of the hot displacer and the cold displacer can be employed. For example, the additional ambient space of variable volume can be disposed between the first part and the second part of the ambient space of the device shown in FIG. 1.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A thermally operated refrigerator comprising:

a first casing and a second casing connected to each other, each casing containing an operating fluid;

a hot space disposed within the first casing for absorbing heat from an outer heat source at a high temperature;

an ambient space having a first portion disposed within the first casing and a second portion disposed within the second casing;

a heat accumulator disposed within the first casing between the hot space and the first portion of the ambient space;

a reciprocating hot displacer whose reciprocal movement establishes a periodic movement of the operating fluid in the first casing for rejecting the heat absorbed at the hot space to the first portion of the ambient space;

a cold space disposed in the second casing for absorbing heat from a load at a low temperature;

a cooler disposed in the second casing between the cold space and the second portion of the ambient space;

a reciprocating cold displacer whose reciprocal movement establishes a periodic movement of the operating fluid in the second casing for rejecting the heat absorbed at the cold space to the second portion of the ambient space;

a mechanism for concurrently driving the hot displacer and the cold displacer;

an additional ambient space disposed between the first portion and the second portion of the ambient space and defined by a piston; and driving means for moving the piston to vary a volume of the additional ambient space.

2. A thermally operated refrigerator in accordance with claim 1, wherein the driving means is a crank mechanism.

3. A thermally operated refrigerator in accordance with claim 1, wherein the driving means is an electromagnetic force.

4. A thermally operated refrigerator in accordance with claim 1, wherein the piston has two sides, the piston being supported at one side by spring means for constituting a resonant system, the other side of the piston being exposed to the additional ambient space.

5. A thermally operated refrigerator in accordance with claim 4, wherein the spring means is a wire spring.

6. A thermally operated refrigerator in accordance with claim 4, wherein the spring means is a gas spring.

7. A thermally operated refrigerator in accordance with claim 1, wherein the hot displacer and the cold displacer move in phase, the piston being out of phase by 90 degrees relative to the hot displacer.

8. A thermally operated refrigerator in accordance with claim 1, wherein the hot displacer and the cold displacer move out of phase with each other, the piston being out of phase by 90 degrees relative to the hot displacer.

9. A thermally operated refrigerator in accordance with claim 1, including a third casing connected to the first casing and the second casing, said piston being disposed in the third casing.

10. A thermally operated refrigerator in accordance with claim 1, wherein the first casing and the second casing each include an upper portion and a lower portion, the hot displacer being located in the lower portion of the first casing and the cold displacer being located in the lower portion of the second casing.

11. A thermally operated refrigerator in accordance with claim 10, wherein the heat accumulator is positioned in the upper portion of the first casing and the cooler is disposed in the upper portion of the second casing.

* * * * *